US005742985A

United States Patent [19]

Larrabee

[11] Patent Number: 5,742,985

[45] Date of Patent: Apr. 28, 1998

[54] CLIP-ON CAMOUFLAGE OUTFIT ACCESSORY

[76] Inventor: Christopher M. Larrabee, 107 N. Blake Rd. Apt. 205, Hopkins, Minn. 55343

[21] Appl. No.: 772,594

[22] Filed: Dec. 23, 1996

[51] Int. Cl.[6] ..... A41F 1/00

[52] U.S. Cl. ..... 24/563; 24/706.1; 24/707.7; 248/316.7

[58] Field of Search ..... 248/316.7, 316.5, 248/316.6; 224/182; 24/563, 543, 706.1, 707.6

[56] References Cited

U.S. PATENT DOCUMENTS 1,056,609 3/1913 Walton ..... 24/706.1 X
4,923,153 5/1990 Matsui et al. ..... 248/316.5 X
5,598,608 2/1997 Naslund ..... 24/543 X
5,653,003 8/1997 Freeman ..... 24/543

*Primary Examiner*—Ramon O. Ramirez

[57] ABSTRACT

A clip-on camouflage outfit accessory comprises a base backing having an upper surface and a lower surface, the base backing including two apertures extending therethrough, the base backing having a first end including an clip release projecting upwardly therefrom and a second end including a hinge member projecting upwardly therefrom, the base backing being couplable to a user's item of camouflage clothing; and a branch clip being having a first end, a second end, an upper surface and a lower surface, the first end of the branch clip being couplable to the clip release of the base backing, the second end of the branch clip being hingedly coupled to the hinge member of the base backing, in an operative orientation a user securing small branches of foliage with the branch clip.

4 Claims, 3 Drawing Sheets

CLIP-ON CAMOUFLAGE OUTFIT ACCESSORY

BACKGROUND OF THE INVENTION

1. Field of the Invention

The present invention relates to a clip-on camouflage outfit accessory and more particularly pertains to securely retaining foliage to attach to a user's camouflage outfit with a clip-on camouflage outfit accessory.

2. Description of the Prior Art

The use of hunting accessories is known in the prior art. More specifically, hunting accessories heretofore devised and utilized for the purpose of enhancing hunting attire are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,037,052 to Crisp et al. discloses a clamp assembly system.

U.S. Pat. No. 4,395,799 to Batts discloses a spring biased plastic article clamp.

U.S. Pat. No. Des. 306,876 to Greenhut et al. discloses a spring clip.

U.S. Pat. No. 4,277,864 to Orson, Sr. discloses a spring operated clip.

U.S. Pat. No. 4,813,441 to Kepley discloses a camouflage device for hunter's seat.

U.S. Pat. No. 4,792,471 to Lee discloses a body wrap camouflage strip for hunters.

While these devices fulfill their respective, particular objective and requirements, the aforementioned patents do not describe a clip-on camouflage outfit accessory for securely retaining foliage to attach to a user's camouflage outfit.

In this respect, the clip-on camouflage outfit accessory according to the present invention substantially departs from the conventional concepts and designs of the prior art, and in doing so provides an apparatus primarily developed for the purpose of securely retaining foliage to attach to a user's camouflage outfit.

Therefore, it can be appreciated that there exists a continuing need for new and improved clip-on camouflage outfit accessory which can be used for securely retaining foliage to attach to a user's camouflage outfit. In this regard, the present invention substantially fulfills this need.

SUMMARY OF THE INVENTION

In the view of the foregoing disadvantages inherent in the known types of hunting accessories now present in the prior art, the present invention provides an improved clip-on camouflage outfit accessory. As such, the general purpose of the present invention, which will be described subsequently in greater detail, is to provide a new and improved clip-on camouflage outfit accessory and method which has all the advantages of the prior art and none of the disadvantages.

To attain this, the present invention essentially comprises a new and improved clip-on camouflage outfit accessory comprising, in combination: a base backing formed in a generally rectangular configuration with an upper surface and a lower surface, the base backing having two circular apertures extending therethrough, the base backing having a first end and a second end, the first end including an elongated semicircular clip release projecting upwardly therefrom, the second end including a generally semicircular hinge member projecting upwardly therefrom; a branch clip being formed in a generally arched configuration and having a first end, a second end, an upper surface and a lower surface, the first end of the branch clip being couplable to the clip release of the base backing, the second end of the branch clip being hingedly coupled to the hinge member of the base backing, the lower surface of the branch clip including a plurality of generally triangular grabbing teeth affixed thereto, in an operative orientation a user securing small branches of foliage with the branch clip; and a safety pin being positioned through the apertures in the base backing, the pin having an upper region including foam backing affixed thereto, the pin being couplable to an item of camouflage clothing.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved clip-on camouflage outfit accessory which has all the advantages of the prior art hunting accessories and none of the disadvantages.

It is another object of the present invention to provide a new and improved clip-on camouflage outfit accessory which may be easily and efficiently manufactured and marketed.

It is a further object of the present invention to provide a new and improved clip-on camouflage outfit accessory which is of durable and reliable construction.

An even further object of the present invention is to provide a new and improved clip-on camouflage outfit accessory which is susceptible of a low cost of manufacture with regard to both materials and labor, and which accordingly is then susceptible of low prices of sale to the consuming public, thereby making such a clip-on camouflage outfit accessory economically available to the buying public.

Even still another object of the present invention is to provide a new and improved clip-on camouflage outfit accessory for securely retaining foliage to attach to a user's camouflage outfit.

Lastly, it is an object of the present invention to provide a new and improved clip-on camouflage outfit accessory comprising: a base backing having an upper surface and a lower surface, the base backing including two apertures extending therethrough, the base backing having a first end including an clip release projecting upwardly therefrom and a second end including a hinge member projecting upwardly therefrom, the base backing being couplable to a user's item of camouflage clothing; and a branch clip being having a first end, a second end, an upper surface and a lower surface, the first end of the branch clip being couplable to the clip release of the base backing, the second end of the branch clip being hingedly coupled to the hinge member of the base backing, in an operative orientation a user securing small branches of foliage with the branch clip.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
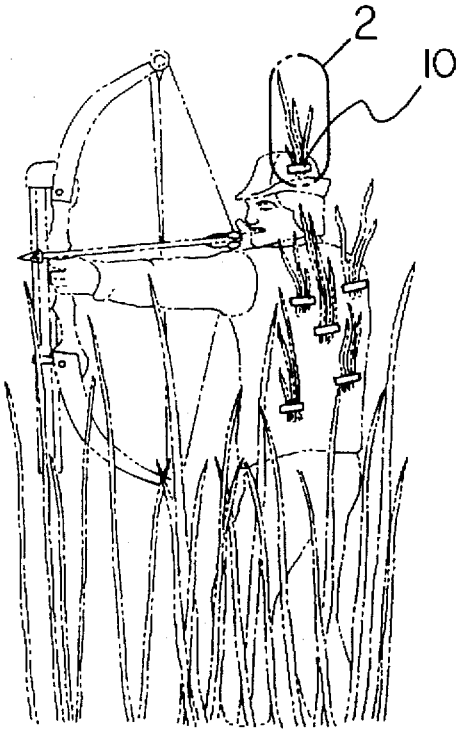
FIG. 1 is a perspective view of the preferred embodiment of the clip-on camouflage outfit accessory constructed in accordance with the principles of the present invention.
Figure 2:
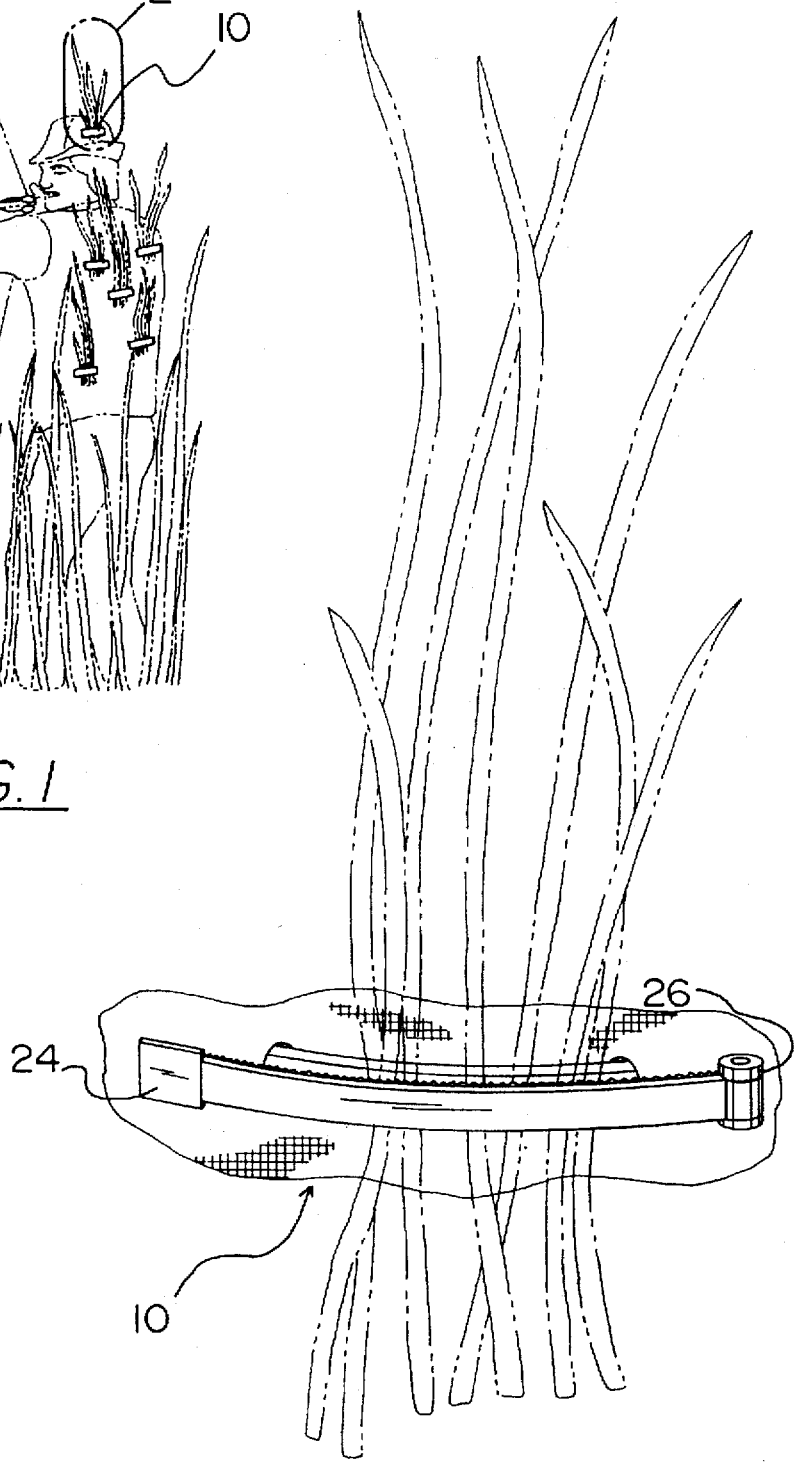
FIG. 2 is a enlarged perspective view illustrating the branch clip of the apparatus.
Figure 3:
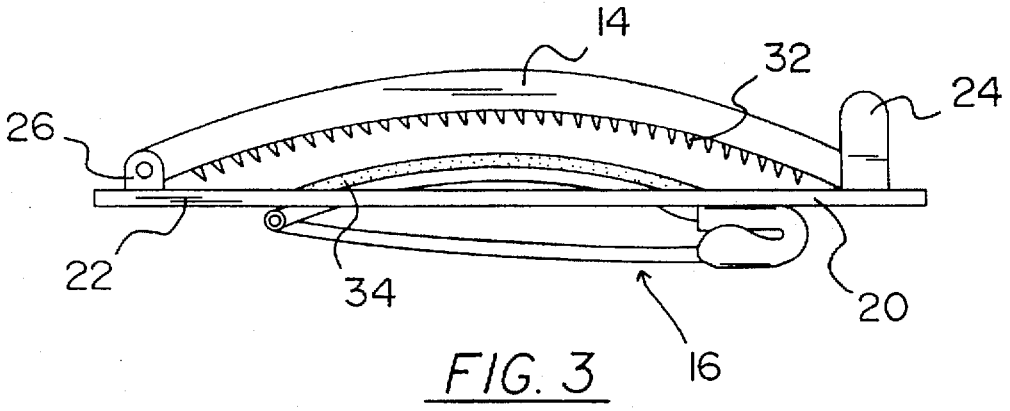
FIG. 3 is a top perspective view of the apparatus illustrating the pin.
Figure 4:
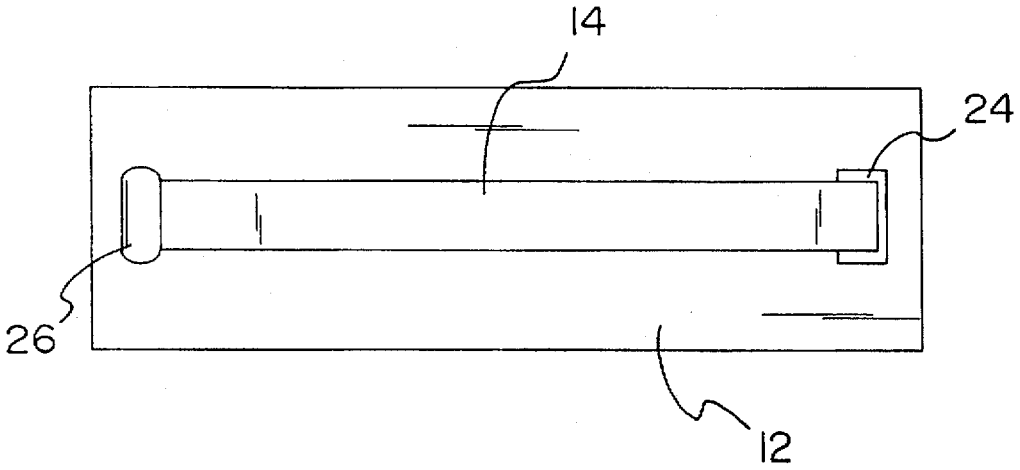
FIG. 4 is a top perspective view of the apparatus illustrating the branch clip.
Figure 5:
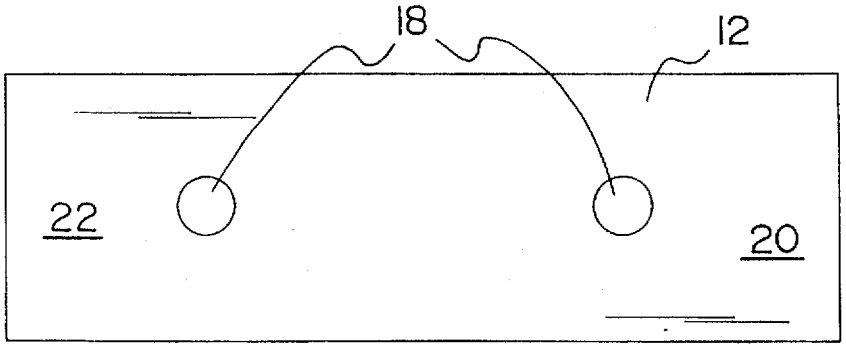
FIG. 5 is a bottom perspective view of the apparatus illustrating the base backing.
Figure 6:
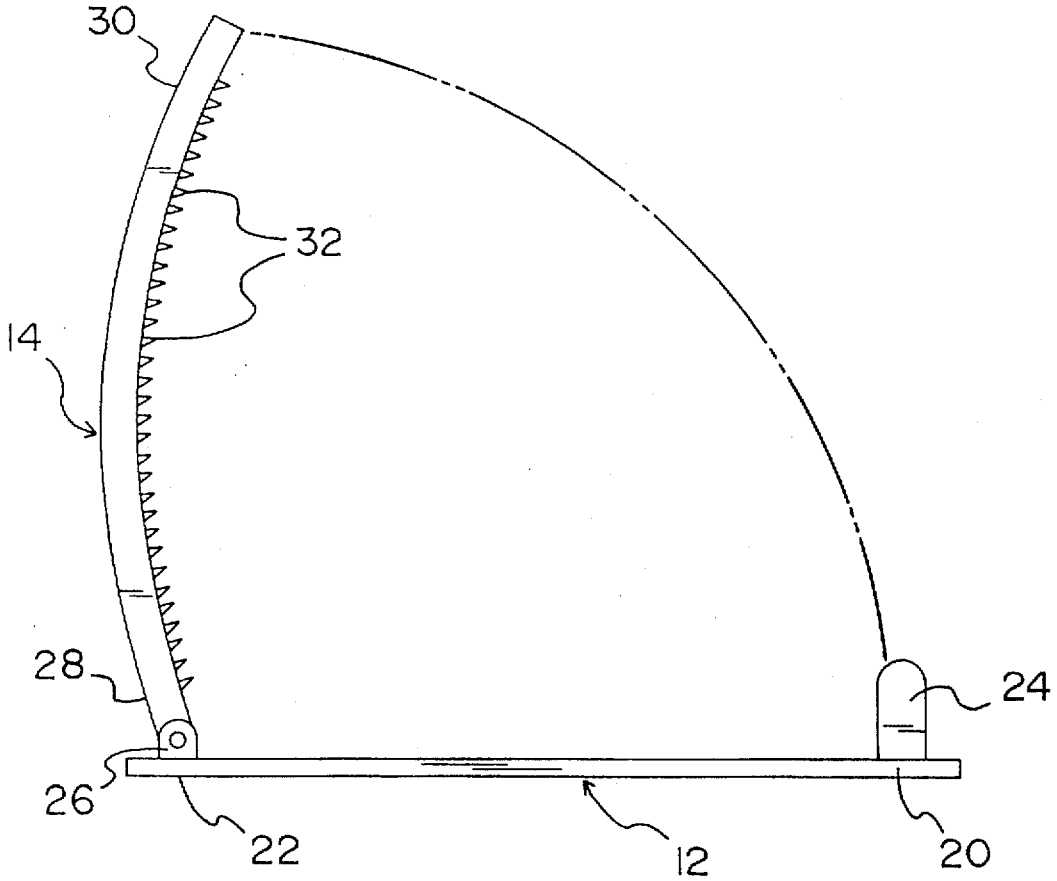
FIG. 6 a side perspective view of the apparatus in an open orientation.

With reference now to the drawings, and in particular, to FIG. 1 thereof, the preferred embodiment of the new and improved clip-on camouflage outfit accessory embodying the principles and concepts of the present invention and generally designated by the reference number 10 will be described.

Specifically, it will be noted in the various Figures that the device relates to a clip-on camouflage outfit accessory 10. In its broadest context, the device consists of a base backing 12, a branch clip 14 and a safety pin 16. Such components are individually configured and correlated with respect to each other so as to attain the desired objective.

The present invention is a unique and simple way to actually change the look of a hunter's camouflage outfit according the immediate surroundings. The base backing 12 is formed in a generally rectangular configuration with an upper surface and a lower surface. In the preferred embodiment of the apparatus the base backing is fabricated of leather. In the preferred embodiment the base backing is fabricated of plastic, rubber, or light metal. The base backing has two circular apertures 18 extending through it. The base backing has a first end 20 and a second end 22. The first end includes an elongated semicircular clip release 24 projecting upwardly from it. The second end includes a generally semi-circular hinge member 26 projecting upwardly from it. Note FIGS. 2–6.

The branch clip 14 is formed in a generally arched configuration and has a first end 28, a second end 30, an upper surface and a lower surface. The first end of the branch clip is couplable to the clip release 24 of the base backing. The second end of the branch clip is hingedly coupled to the hinge member 26 of the base backing. The lower surface of the branch clip includes a plurality of generally triangular grabbing teeth 32. In an operative orientation a user secures small branches of trees, twigs, cattails, leaves and grasses with the branch clip. The curved configuration of the apparatus is specially designed for holding the above mentioned foliage. When attached to the hunter's clothing, the present invention will help break up his of her silhouette and allow full adaptability in many situations. Note FIGS. 1 and 2.

The heavy duty safety pin 16 is positioned through the apertures in the base backing. The pin has an upper region which includes foam backing 34. The pin is couplable to an item of camouflage clothing. This enhances the camouflage effect of the clothing. The construction of the apparatus provides several advantages for the user. The apparatus can be placed anywhere the hunter chooses and can be removed in situations very quickly. The apparatus is very easy to use and allows the hunter to change his camouflage according to the immediate surroundings. The apparatus would be useful to those participating in bow-hunting, paintball/splatball matches, turkey hunters and water fowlers. Finally, the apparatus provides an aesthetically pleasing 3-D effect.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and uses are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A new and improved clip-on camouflage outfit accessory comprising, in combination:

a base backing formed in a generally rectangular configuration with an upper surface and a lower surface, the base backing having two circular apertures extending therethrough, the base backing having a first end and a second end, the first end including an elongated semi-circular clip release projecting upwardly therefrom, the second end including a generally semi-circular hinge member projecting upwardly therefrom;

a branch clip being formed in a generally arched configuration and having a first end, a second end, an upper surface and a lower surface, the first end of the branch clip being couplable to the clip release of the base backing, the second end of the branch clip being hingedly coupled to the hinge member of the base backing, the lower surface of the branch clip including a plurality of generally triangular grabbing teeth affixed thereto, in an operative orientation a user securing small branches of foliage with the branch clip; and a safety pin being positioned through the apertures in the base backing, the pin having an upper region including foam backing affixed thereto, the pin being couplable to an item of camouflage clothing.

2. A clip-on camouflage outfit accessory comprising:

a base backing having an upper surface and a lower surface, the base backing including two apertures extending therethrough, the base backing having a first end including an clip release projecting upwardly therefrom and a second end including a hinge member projecting upwardly therefrom, the base backing being couplable to a user's item of camouflage clothing;

a branch clip being having a first end, a second end, an upper surface and a lower surface, the first end of the branch clip being couplable to the clip release of the base backing, the second end of the branch clip being hingedly coupled to the hinge member of the base backing, in an operative orientation a user securing small branches of foliage with the branch clip; and a safety pin being positioned through the apertures in the base backing, the pin being couplable to an item of camouflage clothing.

3. The clip-on camouflage outfit as set forth in claim 2 wherein the lower surface of the branch clip includes a plurality of generally triangular grabbing teeth affixed thereto.

4. The clip-on camouflage outfit as set forth in claim 3 wherein the pin has an upper region including foam backing affixed thereto.

* * * * *